US010267333B2

(12) United States Patent
Liang

(10) Patent No.: US 10,267,333 B2
(45) **Date of Patent: *Apr. 23, 2019**

(54) CROSS-FLOW WAVE MAKING PUMP

(71) Applicant: Guangzhou Maiguang Electronic Science Technology Co., Ltd., Guangzhou, Guangdong (CN)

(72) Inventor: Weixin Liang, Guangzhou (CN)

(73) Assignee: Guangzhou Maiguang Electronic Science Technology Co., Ltd., Guangzhou, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/597,522

(22) Filed: May 17, 2017

(65) Prior Publication Data

US 2017/0248141 A1 Aug. 31, 2017

Related U.S. Application Data

(63) Continuation-in-part of application No. 14/358,739, filed as application No. PCT/CN2014/075205 on Apr. 11, 2014, now Pat. No. 9,709,059.

(30) Foreign Application Priority Data

Apr. 2, 2014 (CN) ..... 2014 2 0159547 U

(51) Int. Cl.
*F04D 29/44* (2006.01)
*F04D 29/20* (2006.01)
(Continued)

(52) U.S. Cl.
CPC ..... *F04D 29/445* (2013.01); *F04D 1/00* (2013.01); *F04D 1/02* (2013.01); *F04D 1/12* (2013.01);
(Continued)

(58) Field of Classification Search
CPC . F04D 29/445; F04D 1/00; F04D 1/02; F04D 1/12; F04D 13/086; F04D 17/04;
(Continued)

(56) References Cited

U.S. PATENT DOCUMENTS 3,940,215 A * 2/1976 Hori ..... F04D 17/04 415/53.3
4,264,276 A * 4/1981 Massey ..... B63H 5/02 416/184
(Continued)

FOREIGN PATENT DOCUMENTS

CN 101793255 A † 8/2010
GB 983901 2/1965
(Continued)

OTHER PUBLICATIONS

English Translation of CN 101793255, 8 pp.

*Primary Examiner* — Kevin F Murphy
*Assistant Examiner* — Kelsey E Cary
(74) *Attorney, Agent, or Firm* — James A. Sheridan; Sheridan Law, LLC

(57) ABSTRACT

This invention relates to a cross-flow wave making pump comprising an impeller shell forming a water intake and a water outlet, an impeller assembly pivotally connected to two ends of the impeller shell, and a motor used for driving the impeller assembly; wherein, the impeller assembly comprises an impeller used for driving a liquid flow, a first turntable and a second turntable respectively fixed at two ends of the impeller, wherein the first turntable is provided with a shaft rotatably mounted in the impeller shell, the second turntable is provided with a cavity used for receiving a rotor shaft of the motor. The embodiments of the present invention can provide a sufficient liquid-circulation in a container, and significantly reduce the dead zone where the
(Continued)

liquid flows extremely slowly. Other embodiments are disclosed.

16 Claims, 6 Drawing Sheets

(51) Int. Cl.

| | |
|---|---|
| ***F04D 17/04*** | (2006.01) |
| ***F04D 1/00*** | (2006.01) |
| ***F04D 13/08*** | (2006.01) |
| ***F04D 35/00*** | (2006.01) |
| ***F04D 1/12*** | (2006.01) |
| ***F04D 29/043*** | (2006.01) |
| ***F04D 29/22*** | (2006.01) |
| ***F04D 29/42*** | (2006.01) |
| ***F04D 1/02*** | (2006.01) |

(52) U.S. Cl.
CPC ..... *F04D 13/086* (2013.01); *F04D 17/04* (2013.01); *F04D 29/043* (2013.01); *F04D 29/20* (2013.01); *F04D 29/22* (2013.01); *F04D 29/4293* (2013.01); *F04D 35/00* (2013.01)

(58) Field of Classification Search
CPC ..... F04D 29/043; F04D 29/292; F04D 29/22; F04D 29/4293; F04D 35/00
USPC ..... 415/53.1, 53.2, 53.3; 416/178, 184
See application file for complete search history.

(56) References Cited

U.S. PATENT DOCUMENTS

| | | | | |
|---|---|---|---|---|
| 6,217,541 | B1 † | 4/2001 | Yu | |
| 2003/0202880 | A1 | 10/2003 | Koochingchai | |
| 2006/0172682 | A1 | 8/2006 | Orr | |
| 2007/0252460 | A1 | 11/2007 | Cheng | |
| 2009/0067982 | A1 | 3/2009 | Ko | |
| 2010/0158664 | A1 † | 6/2010 | Ko | |
| 2010/0237625 | A1 * | 9/2010 | Dempster | F03B 7/00 290/54 |
| 2012/0219434 | A1 | 8/2012 | Tai | |

FOREIGN PATENT DOCUMENTS

| | | | |
|---|---|---|---|
| GB | 983901 | A † | 2/1965 |
| JP | 2012005947 | A † | 1/2012 |

* cited by examiner
† cited by third party

CROSS-FLOW WAVE MAKING PUMP

REFERENCE TO PENDING PRIOR PATENT APPLICATIONS

This patent application is a continuation-in-part of pending prior U.S. patent application Ser. No. 14/358,739, filed Apr. 11, 2014 by Weixin Liang for CROSS-FLOW WAVE MAKING PUMP, which is a National Stage Entry of International Application No. PCT/CN2014/075205, filed Apr. 11, 2014 by Weixin Liang for CROSSFLOW-TYPE FLOW PUMP, which in turn claims priority to Chinese Application No. 201420159547.1, filed Apr. 2, 2014 by Weixin Liang, all of which patent applications are hereby incorporated herein by reference.

FIELD OF THE INVENTION

This invention relates to a wave making pump, especially to a cross-flow wave making pump that can provide a sufficient liquid-circulation in a container.

BACKGROUND OF THE INVENTION

In most cases, existing wave making pumps use inner rotor brushless motor with propeller-type axial vanes to drive a liquid flow, or use inner rotor brushless motor with centrifugal vanes to swallow and extrude liquid so as to force the liquid to flow. The inner rotor brushless motor is characterized by high rotation speed but low torque, so it can only drive small-sized vanes, moreover, the outlet area of this kind of wave making pumps is relatively small, when a high flow velocity is required, it needs to increase the rotation speed to increase the flow rate. Therefore, when this kind of wave making pump is applied to making liquid circulation or making waves, it's likely to cause uneven flow or insufficient liquid-circulation, and form, in the container, dead zones where the liquid flows extremely slowly.

SUMMARY OF THE INVENTION

To overcome the defects in the prior art, the present invention provides a cross-flow wave making pump which can provide a sufficient liquid-circulation in a container, and significantly reduce the dead zone where the liquid flows extremely slow.

To achieve the above goals, the present invention provides the following technical solution.

The present invention provides a cross-flow wave making pump comprising an impeller shell forming a water intake and water outlet, an impeller assembly pivotally connected to two ends of the impeller shell, and a motor used for driving the impeller assembly.

Wherein the impeller assembly comprises an impeller used for driving a liquid flow, a first turntable and a second turntable respectively fixed at two ends of the impeller, wherein the first turntable is provided with a shaft rotatably mounted in the impeller shell, the second turntable is provided with a cavity used for receiving a rotor shaft of the motor.

Preferably, the cross-flow wave making pump has two impeller assemblies and two impeller shells, each side of the motor is provided with one impeller assembly and one impeller shell.

Preferably, the impeller comprises a first vane and a second vane, a third turntable is located between the first turntable and the second turntable, the first vane is fixed between the first turntable and the third turntable, the second vane is fixed between the second turntable and the third turntable; a plurality of the first vanes are circumferentially arranged along an axis of the first turntable, and a plurality of the second vanes are circumferentially arranged along an axis of the second turntable.

Preferably, the impeller shell comprises a first sleeve and a second sleeve that are disposed parallel to each other and are connected by an arc-shaped shell, the second sleeve sleeves a stator of the motor, a flow-guiding plate is provided above the arc-shaped shell.

Preferably, the first sleeve is clamped with an end cover, the end cover is inserted with a bushing rubber pad, the bushing rubber pad is inserted with a bushing, and the bushing is rotatably inserted with the shaft.

Preferably, the impeller shell further comprises a tongue piece crossing between the first sleeve and the second sleeve and connecting the first sleeve and the second sleeve, a space between the tongue piece and the flow-guiding plate forms the water outlet, a space between the tongue piece and a lower side of the arc-shaped shell forms the water intake.

Preferably, the tongue piece comprises a first tongue piece and a second tongue piece that are disposed parallel to each other, one side of the first tongue piece is connected to a same side of the second tongue piece by a vertically fixed third tongue piece, a plurality of reinforcing ribs are fixed between the first tongue piece and the second tongue piece.

Preferably, the cavity is inserted with a soft rubber pad, and the rotor shaft of the motor is inserted in the soft rubber pad.

Preferably, the shaft is a ceramic shaft.

Preferably, the motor is an outer rotor motor.

The beneficial effects of the cross-flow wave making pump of the present invention are as follows.

The cross-flow wave making pump of the present invention drives the impeller assembly pivotally connected to the two ends of the impeller shell by the motor, so as to force the liquid to circulate, wherein the impeller assembly comprises the impeller used for driving a liquid flow, the first turntable and the second turntable respectively fixed at the two ends of the impeller, wherein the first turntable is provided with the shaft rotatably mounted in the impeller shell, the second turntable is provided with the cavity used for receiving the rotor shaft of the motor. By rotating the impeller assembly, the cross-flow wave making pump of the present invention creates a sufficient liquid-circulation in the container, which significantly reduces the dead zone where the liquid flows extremely slowly; furthermore, the cross-flow wave making pump has two impeller assemblies and two impeller shells, each side of the motor is provided with one impeller assembly and one impeller shell, in this way, the cross-flow wave making pump of the present invention makes a further contribution to the liquid-circulation. In addition, the motor is an outer rotor motor, such that the impeller assemblies can obtain a relatively high torque. Therefore, the motor can drive a big-sized strip-shaped impeller so as to overcome the defect that the torque of an inner motor brushless motor is relatively small.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

LIST OF REFERENCE NUMERALS OF MAIN COMPONENTS

Figure 1:
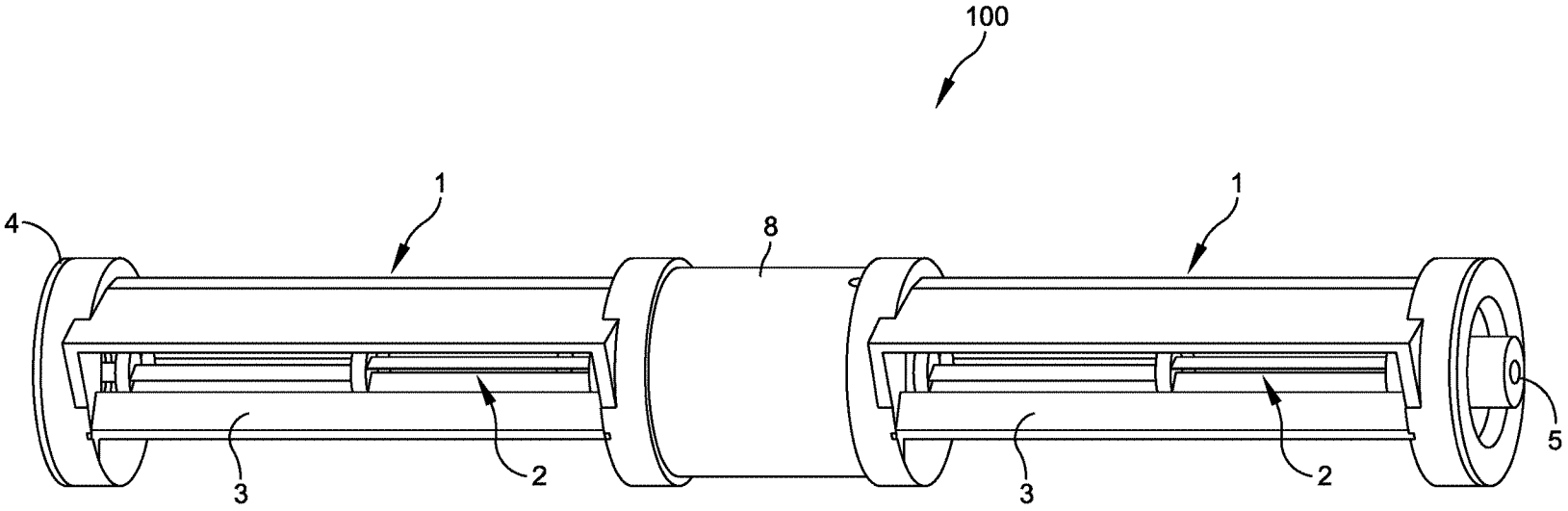
FIG. 1 is a schematic structural diagram of a cross-flow wave making pump.
Figure 2:
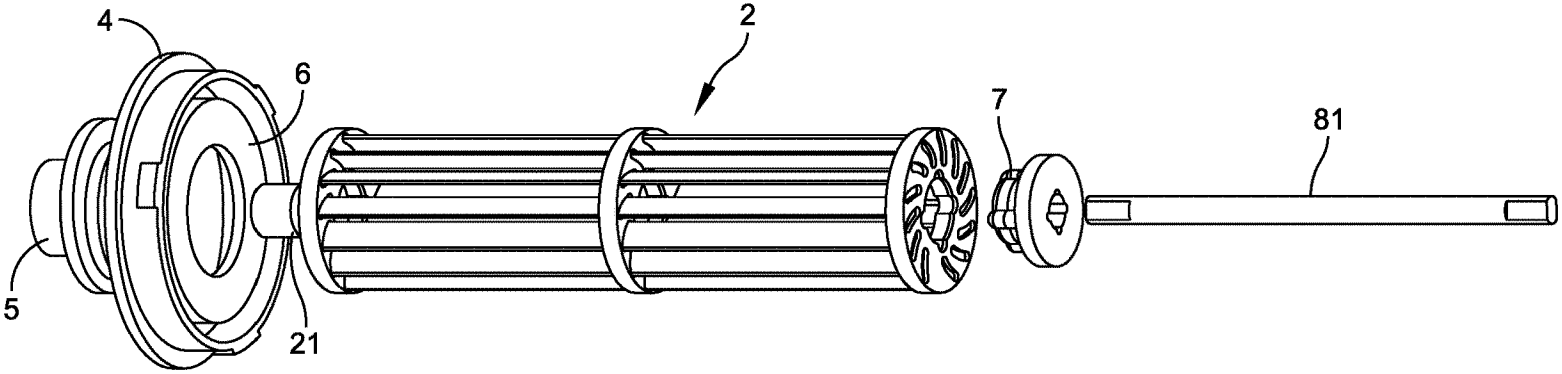
FIG. 2 is a schematic structural diagram of a part of a cross-flow wave making pump of the present invention.

100 cross-flow wave making pump
1 impeller shell
11 first sleeve
12 second sleeve
13 arc-shaped shell
14 flow-guiding plate
2 impeller assembly
21 shaft
22 first turntable
23 third turntable
24 second turntable
25 first vane
26 second vane
27 cavity
3 tongue piece
31 first tongue piece
32 second tongue piece
33 third tongue piece
34 reinforcing rib
4 end cover
5 bushing rubber pad
6 bushing
7 soft rubber pad
8 motor
81 rotor shaft
50 top longitudinal edge of the arc-shaped shell
52 bottom longitudinal edge of the arc-shaped shell
54 arcuate wall of the arc-shaped shell
56 center point of the arcuate wall
58 longitudinal axis of the pump
60 apex of the arcuate wall
62 perpendicular axis defined by the apex of the arcuate wall and the longitudinal axis
64 water outlet
66 water intake
68 aquarium tank
70 first flow pattern
72 second flow pattern

DETAILED DESCRIPTION

Varied embodiments will now be described with reference to the figures.

Pumping systems in aquarium tanks and containers provide a number of key functions, including moving water and/or debris to or from the tank filtration systems, creating currents within the tank for fish, assisting with draining and/or filling of the tank, oxygenating the water, maintaining an even water temperature throughout the tank, and/or promoting beneficial bacteria growth throughout the tank. Sufficient water circulation through the tank is integral to these functions. Traditional water pumps rely on high flow velocity and high hydraulic head, thereby requiring particular positioning within the tank (e.g., at a sufficient depth within the tank to achieve the requisite hydraulic head), which oftentimes results in proper circulation only within certain portions of the tank, leaving dead zones where the water flows extremely slowly.

Embodiments of the cross-flow wave making pump discussed herein provide a pump that forms a static pressure difference within the impeller, along with a water inlet and outlet configured to provide continuous water flow through the impeller, regardless of the pump's positioning within the tank. Thus, the pump may be attached at any advantageous vertical or horizontal position along the tank's walls to generate a desired gyre-type flow pattern within the tank.

As shown in FIG. 1-FIG. 5, a cross-flow wave making pump 100 of the present invention comprises an impeller shell 1 forming a water intake and a water outlet, an impeller assembly 2 pivotally connected to two ends of the impeller shell 1, and a motor 8 used for driving the impeller assembly 2.

Wherein the impeller assembly 2 comprises an impeller used for driving a liquid flow, a first turntable 22 and a second turntable 24 respectively fixed at two ends of the impeller, wherein the first turntable 22 is provided with a shaft 21 rotatably mounted in the impeller shell 1, the second turntable 24 is provided with a cavity 27 used for receiving a rotor shaft 81 of the motor 8.

The cross-flow wave making pump 100 of the present invention drives the impeller assembly 2, pivotally connected to the two ends of the impeller shell 1 by the motor 8, so as to force the liquid to circulate. By rotating the impeller assembly 2, the cross-flow wave making pump of the present invention makes a sufficient liquid-circulation in the container, and hence significantly reduce the dead zone where the liquid flows extremely slowly.

Preferably, the cross-flow wave making pump 100 has two impeller assemblies 2 and two impeller shells 1, each side of the motor 8 is provided with one impeller assembly 2 and one impeller shell 1. In this way, the cross-flow wave making pump of the present invention makes a further contribution to the liquid-circulation in the container.

Figure 4:
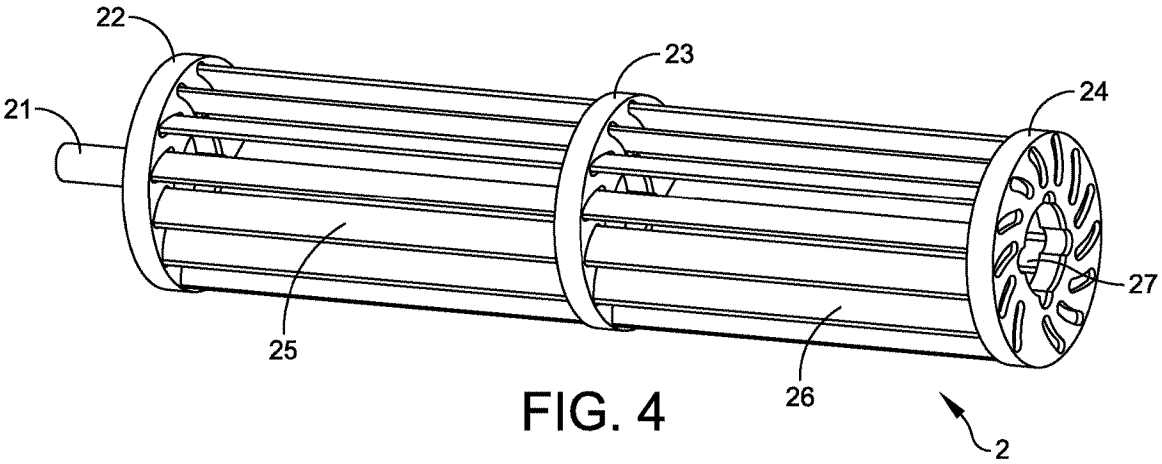
FIG. 4 is a schematic structural diagram of an impeller assembly of the present invention.
Figure 5:
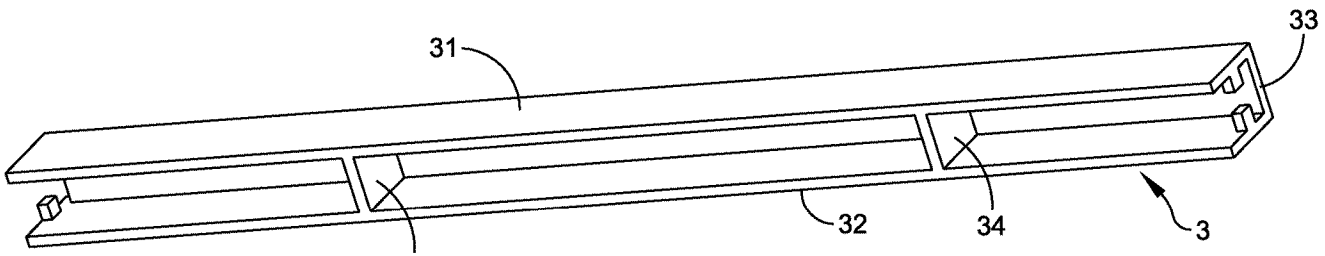
FIG. 5 is a schematic structural diagram of a tongue piece of the present invention.

As shown in FIG. 4, preferably, the impeller comprises a first vane 25 and a second vane 26, a third turntable 23 is located between the first turntable 22 and the second turntable 24, the first vane 25 is fixed between the first turntable 22 and the third turntable 23, the second vane 26 is fixed between the second turntable 24 and third turntable 23; a plurality of the first vanes 25 are circumferentially arranged along an axis of the first turntable 22, and a plurality of the second vanes 26 are circumferentially arranged along an axis of the second turntable 24. In this way, the wave making pump can drive an increased amount of liquid, so as to further reduce the dead zone where the liquid flows extremely slowly.

In addition, the number of the first vane 25 and the second vane 26 can be adjusted, which depends on the size of the container, the volume of the liquid, the properties of the liquid and other actual conditions.

Figure 3:
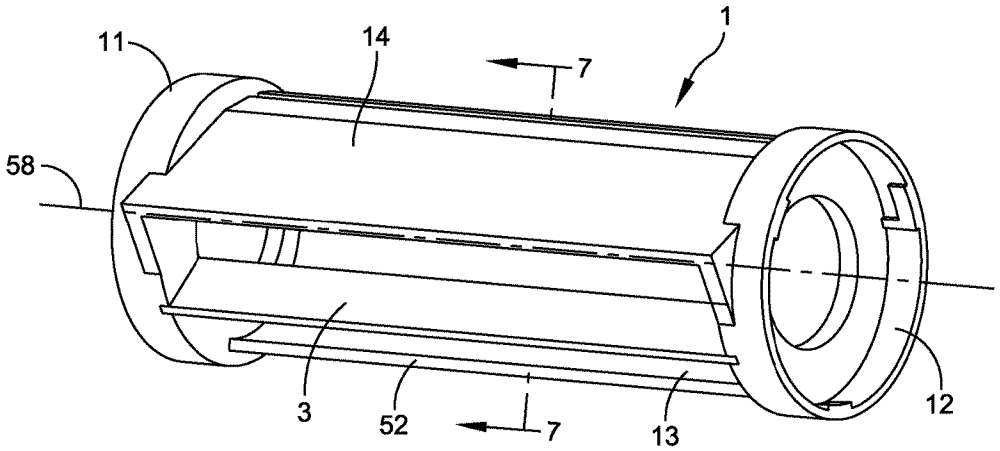
FIG. 3 is a schematic structural diagram of an impeller shell of the present invention.
Figure 7:
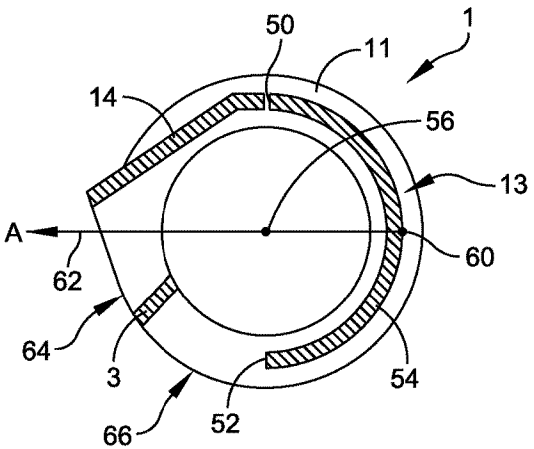
FIG. 7 is a schematic structural diagram presenting a cross-sectional view of the impeller shell of the present invention.
Figure 6:
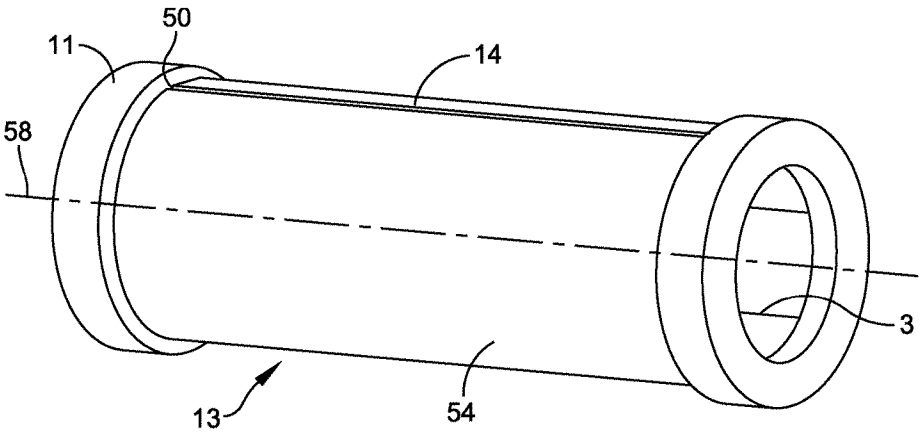
FIG. 6 is a schematic structural diagram presenting a rear perspective view of the impeller shell of the present invention.

As shown in FIGS. 3 and 6-7, preferably, the impeller shell 1 comprises a first sleeve 11 and a second sleeve 12 that are disposed parallel to each other and are connected by an arc-shaped shell 13 having a top longitudinal edge 50 and a bottom longitudinal edge 52. The arc-shaped shell 13, in combination with the impeller assembly 2 coupled thereto, is configured to facilitate continuous water flow through the impeller, as well as efficient positioning and attachment of the pump to the tank wall. In one embodiment, the arc-shaped shell 13 forms an arcuate wall 54 that extends between the top longitudinal edge 50 and the bottom longitudinal edge 52 of the arc-shaped shell 13. A center point 56 of the arcuate wall 54 defines a longitudinal rotational axis 58 of the pump, and an apex 60 of the arcuate wall 54 and the longitudinal rotational axis 58 define a perpendicular axis 62 that extends from the apex 60 of the arcuate wall 54 in an outward direction, A.

The second sleeve 12 of the impeller shell 1 sleeves or houses a stator of the motor 8 (FIG. 1), and a flow-guiding plate 14 is provided above the arc-shaped shell 13, or adjacent to the top longitudinal edge 50 of the arc-shaped shell 13. With the help of the flow-guiding plate 14, the direction of the liquid flow can be effectively guided.

Preferably, the first sleeve 11 is clamped with an end cover 4, the end cover 4 is inserted with a bushing rubber pad 5, the bushing rubber pad 5 is inserted with a bushing 6, and the bushing 6 is rotatably inserted with the shaft 21. Owning to the bushing rubber pad 5 and the bushing 6, the abrasions of the shaft 21 and the end cover 4 are significantly reduced, which effectively extends the service life of the shaft 21.

Preferably, the impeller shell 1 further comprises a tongue piece 3 crossing between the first sleeve 11 and the second sleeve 12 and connecting the first sleeve 11 and the second sleeve 12. A space between the tongue piece 3 and the flow-guiding plate 14 forms a water outlet 64, and a space between the tongue piece 3 and the bottom longitudinal edge 52 of the arc-shaped shell 13 forms a water intake 66. Given the configuration of the arc-shaped shell 13, discussed above, along with the flow-guiding plate 14 and the tongue piece 3, both the water intake 66 and the water outlet 64 face the outward direction, A. By setting the tongue piece 3, the liquid in the container can form an inflow-outflow circulation, both directed in the outward direction, A, at the impeller assembly 2. This configuration allows for ease of positioning and attaching a back or rear of the pump against the internal tank wall and allows for continuous flow across the impeller assembly 2, without requiring a water intake at the rear of the pump. Tongue piece 3 may be attached to the impeller shell 1 such that it is selectively positionable or adjustable in relation to the impeller assembly 2, thereby allowing the size and/or position of the water intake 66 and the water outlet 64 to be adjusted based upon the positioning of the tongue piece 3.

In addition, in another embodiment of the present invention, it's the space between the tongue piece 3 and the flow-guiding plate 14 that forms the intake, and the space between the tongue piece 3 and the lower side of the arc-shaped shell 13 that forms the outlet.

Preferably, the tongue piece 3 comprises a first tongue piece 31 and a second tongue piece 32 that are disposed parallel to each other, one side of the first tongue piece 31 is connected to a same side of the second tongue piece 32 by a vertically fixed third tongue piece 33, a plurality of reinforcing ribs 34 are fixed between the first tongue piece 31 and the second tongue piece 32.

Preferably, a soft rubber pad 7 is inserted in the cavity 27, the rotor shaft 81 of the motor 8 is inserted in the soft rubber pad 7. Owning to the soft rubber pad 7, the abrasion of rotor shaft 81 of the motor 8 is significantly reduced, which effectively extends the service life of the rotor shaft 81 of the motor 8.

Preferably, the shaft 21 is a ceramic shaft. Since the ceramic shaft is characterized by high strength, high heat resistance, high abrasion resistance, high corrosion resistance, high insulation, etc., the ceramic shaft can be taken as a preferred embodiment of the shaft 21 in the present invention.

Preferably, the motor 8 is an outer rotor motor, so that the impeller assembly 2 can obtain a relatively high torque and the motor 8 can thus drive a big-sized strip-shaped impeller, which overcomes the defect that the torque of the traditional inner rotor brushless motor is relatively small.

The first vane 25 and the second vane 26 of the present invention are fixed to the impeller shell 1 by ultrasonic welding.

After assembling the pump 100 as described above, when powering up the motor 8, the rotor and the rotor shaft 81 of the motor 8 will rotate continuously, the rotor shaft 81 of the motor 8 then drives the first vanes 25 and the second vanes 26 to rotate. With the participation of the impeller shell 1 and the tongue piece 3, a static pressure difference is formed in the impeller, the space between the tongue piece 3 and the flow-guiding plate 14 forms the water outlet, the space between the tongue piece 3 and the lower side of the arc-shaped shell 13 forms the water intake, so that the liquid will continuously flow through the impeller due to the static pressure formed in the impeller. Compared with the traditional wave making pump which requires high flow velocity and high hydraulic head during application, the cross-flow wave making pump of the present invention can create a sufficient liquid-circulation in a container and thus significantly reduce the dead zones where the liquid flows extremely slowly.

Figure 8A:
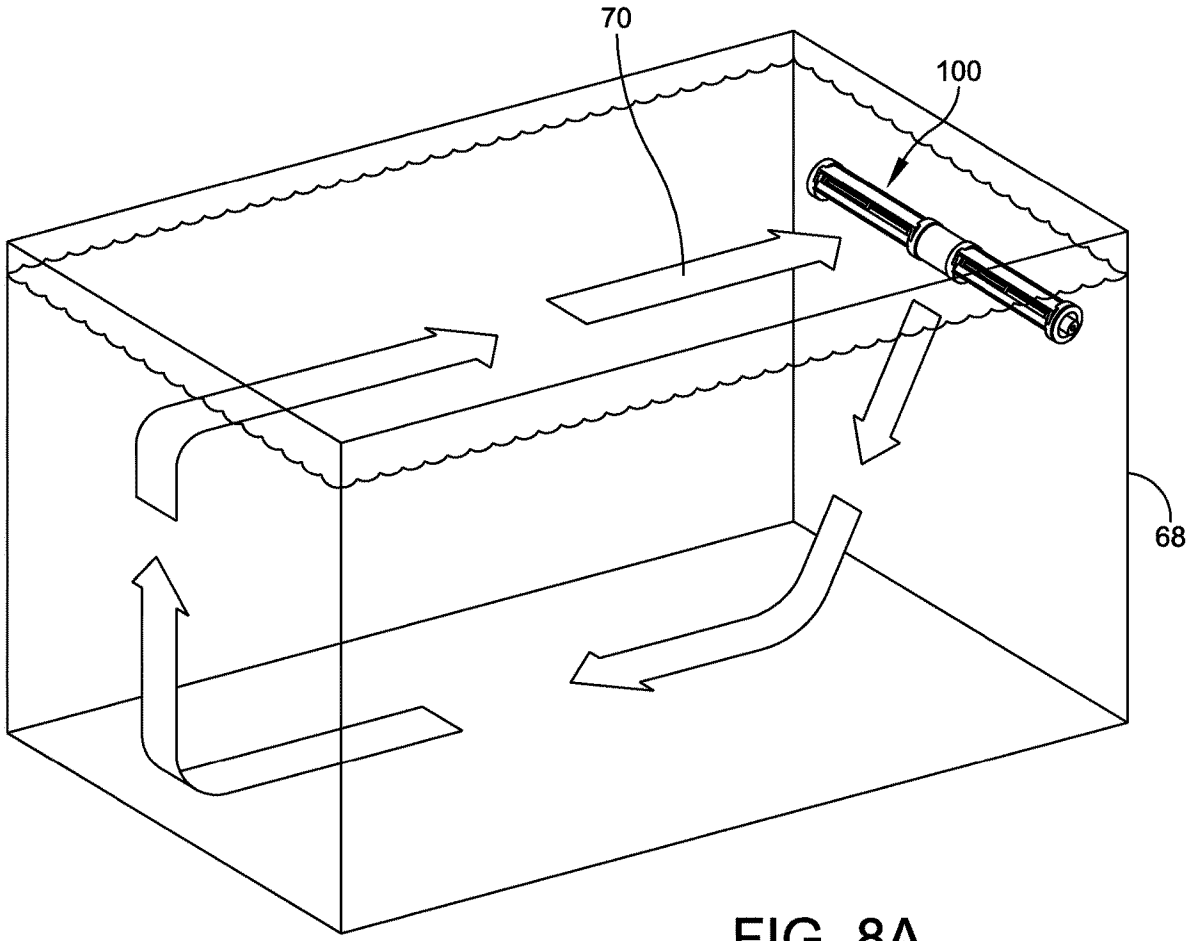
FIGS. 8A-8B provide perspective views of two alternate placements of the cross-flow wave making pump of the present invention within an aquarium container.
Figure 8B:
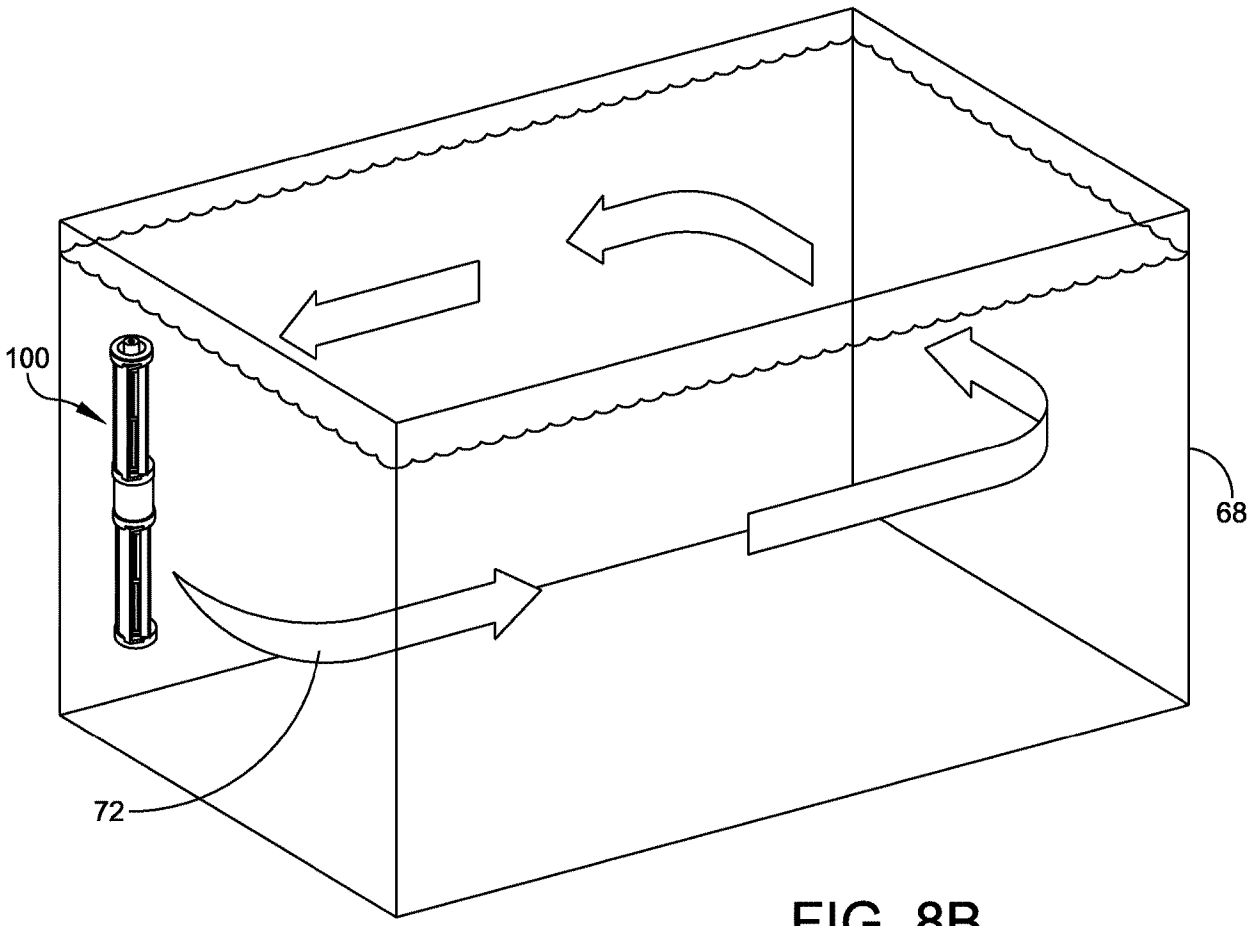

FIGS. 8A-8B illustrate two exemplary positioning alternatives of the cross-flow wave making pump, as installed upon an internal wall of a filled aquarium tank 68. In FIG. 8A, the pump is installed horizontally near a water line of the tank, resulting in a first flow pattern 70. In FIG. 8B, the pump is installed vertically along a near a corner of the tank 68, resulting in a second flow pattern 72. Notably, due to the higher static pressure formed within the impeller assembly 2 and between the impeller assembly 2 and the impeller shell 1 (as opposed to the static pressure formed on the outside of the pump), the pump may be installed in any desirable position to achieve a desired flow pattern (e.g., depending on preferred currents, the location of aquarium accessories, the location of a filtration intake, etc.) without the need to position the pump to achieve a high hydraulic head during operation (e.g., near the bottom of the tank).

The foregoing descriptions are merely specific embodiments of the present invention, but are not intended to limit the protection scope of the present invention. Any variation or replacement readily figured out by persons skilled in the art within the technical scope disclosed in the present invention shall all fall within the protection scope of the present invention.

What is claimed is:

1. A submersible pump for generating a cross-flow wave within an aquarium, the pump comprising:

an impeller shell having a rear half facing a wall of the aquarium and a front half facing opposite the wall of the aquarium, the impeller shell comprising:

an elongated arc-shaped shell comprising an entirety of the rear half of the impeller shell, the elongated arc-shaped shell having first and second longitudinal ends connecting top and bottom longitudinal edges extending therebetween;

an elongated flow-guiding plate disposed on the front half of the impeller shell and extending from the first to the second longitudinal ends of the arc-shaped shell, the flow-guiding plate having a front longitudinal edge and a rear longitudinal edge, the rear longitudinal edge disposed adjacent to the top longitudinal edge of the arc-shaped shell; and an elongated tongue piece disposed on the front half of the impeller shell between the front longitudinal edge of the flow-guiding plate and the bottom longitudinal edge of the arc-shaped shell and extending from the first to the second longitudinal ends of the arc-shaped shell, wherein a water outlet is formed between the front longitudinal edge of the flow-guiding plate and the tongue piece and a water inlet is formed between the bottom longitudinal edge of the arc-shaped shell and the tongue piece, the water inlet and the water outlet disposed on the front half of the impeller shell;

an impeller assembly pivotally connected to two ends of the impeller shell, the impeller assembly comprising an impeller for driving a water flow; and a motor configured to drive the impeller assembly, the motor having a water-tight configuration to drive an entirety of the water flow via the impeller assembly from the water inlet out the water outlet so as to provide a pump for making a cross-flow wave within the aquarium, wherein:

the water flow into the water inlet defines an inward flow direction and the water flow out of the water outlet defines an outward flow direction;

the inward flow direction and the outward flow direction are radially adjacent to one another;

an arcuate wall extends between the top longitudinal edge and the bottom longitudinal edge of the arc-shaped shell;

a center point of the arcuate wall defines a longitudinal rotational axis of the pump;

an apex of the arcuate wall and the longitudinal rotational axis define a perpendicular axis that extends from the apex of the arcuate wall in an outward direction;

the arcuate wall is open toward the outward direction; and the impeller shell further comprises:

a first sleeve and a second sleeve disposed parallel to each other and connected by the arc-shaped shell, the second sleeve housing a stator of the motor.

2. The submersible pump of claim 1, wherein the cross-flow wave making pump comprises two of the impeller assemblies and two of the impeller shells, and wherein each side of the motor is provided with one of the impeller assemblies and one of the impeller shells.

3. The submersible pump of claim 1, wherein when the pump is submersed within a volume of water, a static pressure difference is formed in the impeller.

4. The submersible pump of claim 1, wherein the water inlet and the water outlet face the outward direction.

5. The submersible pump of claim 4, wherein the tongue piece comprises a first tongue piece and a second tongue piece disposed parallel to each other, one side of the first tongue piece is connected to a same side of the second tongue piece by a vertically fixed third tongue piece, a plurality of reinforcing ribs fixed between the first tongue piece and the second tongue piece.

6. The submersible pump of claim 4, wherein:

the first sleeve is clamped with an end cover;

the end cover is inserted with a bushing rubber pad;

the bushing rubber pad is inserted with a bushing; and the bushing is rotatably coupled with a shaft.

7. The submersible pump of claim 1, wherein a soft rubber pad is positioned within a cavity formed in the impeller shell, and a rotor shaft of the motor is inserted in the soft rubber pad.

8. The submersible pump of claim 7, wherein the rotor shaft is a ceramic shaft.

9. The submersible pump of claim 1, wherein the motor is an outer rotor motor.

10. A system for circulating water about an aquarium container, the system comprising:

a volume of water having properties that allow wave motion therein;

a container having a base and sidewalls configured to hold the volume of the water; and a cross-flow wave making pump submersed within the volume of the water, the cross-flow wave making pump comprising:

an impeller shell having a rear half facing one of the sidewalls of the container and a front half facing opposite the one of the sidewalls, the impeller shell comprising:

an elongated arc-shaped shell comprising an entirety of the rear half of the impeller shell, the elongated arc-shaped shell having first and second longitudinal ends connecting top and bottom longitudinal edges extending therebetween;

an elongated flow-guiding plate disposed on the front half of the impeller shell and extending from the first to the second longitudinal ends of the arc-shaped shell, the flow-guiding plate having a front longitudinal edge and a rear longitudinal edge, the rear longitudinal edge disposed adjacent to the top longitudinal edge of the arc-shaped shell; and an elongated tongue piece disposed on the front half of the impeller shell between the front longitudinal edge of the flow-guiding plate and the bottom longitudinal edge of the arc-shaped shell and extending from the first to the second longitudinal ends of the arc-shaped shell, wherein a water outlet is formed between the front longitudinal edge of the flow-guiding plate and the tongue piece and a water inlet is formed between the bottom longitudinal edge of the arc-shaped shell and the tongue piece;

an impeller assembly pivotally connected to the impeller shell at opposing ends of the impeller shell; and a motor configured to drive the impeller assembly, wherein the impeller assembly comprises an impeller used for driving an entirety of a water flow out of the water outlet from the water inlet so as to generate a cross-flow wave within the volume of the water, wherein:

the water flow into the water inlet defines an inward flow direction and the water flow out of the water outlet defines an outward flow direction;

the inward flow direction and the outward flow direction are radially adjacent to one another;

an arcuate wall extends between the top longitudinal edge and the bottom longitudinal edge of the arc-shaped shell;

a center point of the arcuate wall defines a longitudinal rotational axis of the pump;

an apex of the arcuate wall and the longitudinal rotational axis define a perpendicular axis that extends from the apex of the arcuate wall in an outward direction;

the arcuate wall is open toward the outward direction; and a first sleeve and a second sleeve are disposed parallel to each other and connected by the arc-shaped shell, the second sleeve housing a stator of the motor.

11. The system of claim 10, wherein the water inlet and the water outlet face the outward direction.

12. The system of claim 10, wherein:

the first sleeve is clamped with an end cover;

the end cover is inserted with a bushing rubber pad;

the bushing rubber pad is inserted with a bushing; and the bushing is rotatably coupled with a shaft.

13. The system of claim 10, wherein the cross-flow wave making pump comprises two of the impeller assemblies and two of the impeller shells, and wherein each side of the motor is provided with one of the impeller assemblies and one of the impeller shells.

14. The system of claim 10, wherein the impeller comprises a first vane and a second vane.

15. A system for providing water circulation within a container, the system comprising:

a volume of water having properties that allow wave motion therein;

a container having a base and sidewalls configured to hold the volume of the water; and a cross-flow wave making pump forming a single water inlet and a single water outlet, the cross-flow wave making pump comprising:

an impeller shell having an arc-shaped shell with a top longitudinal edge and a bottom longitudinal edge, a flow-guiding plate disposed adjacent to and extending along an entirety of the top longitudinal edge of the arc-shaped shell, and a tongue piece disposed between the flow-guiding plate and the bottom longitudinal edge of the arc-shaped shell, wherein a space between the tongue piece and the bottom longitudinal edge of the arc-shaped shell forms the single water inlet and a space between the tongue piece and the flow-guiding plate forms the single water outlet;

an impeller assembly pivotally connected between two ends of the impeller shell, wherein the impeller assembly comprises an impeller used for driving an entirety of a water flow out of the single water outlet from the single water inlet so as to generate a cross-flow wave within the volume of the water; and a motor used for driving the impeller assembly, wherein a duplicate of each of the impeller shell, the tongue piece, and the impeller assembly are provided on each side of the motor wherein:

the water flow into the single water inlet defines an inward flow direction and the water flow out of the single water outlet defines an outward flow direction; and the inward flow direction and the outward flow direction are radially adjacent to one another, wherein the impeller shell further comprises a first sleeve and a second sleeve disposed parallel to each other and connected by the arc-shaped shell, the second sleeve housing a stator of the motor.

16. The system of claim 15, wherein the arc-shaped shell comprises an arcuate wall extending between the top and the bottom longitudinal edges, a center point of the arcuate wall defining a longitudinal rotational axis of the pump, an apex of the arcuate wall and the longitudinal rotational axis defining a perpendicular axis that extends from the apex of the arcuate wall in an outward direction, and the arcuate wall open toward the outward direction, wherein the single water inlet and the single water outlet face the outward direction.

* * * * *